United States Patent [19]

Haselgrove et al.

[11] 4,192,242

[45] Mar. 11, 1980

[54] HOSIERY TOE CLOSERS

[75] Inventors: Bob Haselgrove; John D. Nichol, both of High Wycombe, England

[73] Assignee: Detexomat Machinery Limited, England

[21] Appl. No.: 891,689

[22] Filed: Mar. 30, 1978

[30] Foreign Application Priority Data

Apr. 2, 1977 [GB] United Kingdom ..... 14005/77

[51] Int. Cl.[2] ..... D05B 1/00; D05B 97/00

[52] U.S. Cl. ..... 112/262.2; 112/121.15

[58] Field of Search ..... 112/121.15, 262, 121.12; 223/39

[56] References Cited

U.S. PATENT DOCUMENTS

| | | | |
|---|---|---|---|
| 3,738,294 | 6/1973 | Christiansen | 112/121.15 |
| 3,859,938 | 1/1975 | Fukuyama | 112/121.15 |
| 3,875,880 | 4/1975 | Hazelgrove et al. | 112/121.15 |
| 3,941,069 | 3/1976 | Fukuyama | 112/262 |

FOREIGN PATENT DOCUMENTS

| | | | |
|---|---|---|---|
| 2524238 | 12/1975 | Fed. Rep. of Germany | 112/121.15 |
| 1408912 | 10/1975 | United Kingdom | 112/121.15 |

*Primary Examiner*—Ronald Feldbaum

*Attorney, Agent, or Firm*—Wellington M. Manning, Jr.; Luke J. Wilburn, Jr.

[57] ABSTRACT

Adjustment of the position of a limp, generally tubular garment item, such as a hosiery blank to be toe seamed, is performed by gripping the garment either internally or externally while it is on the carrier, moving it therealong firstly past the desired position and then back towards that position, and then automatically releasing the grip exerted on the garment when a photodetector senses the arrival of an identifiable feature of the returning garment at the said desired position.

28 Claims, 8 Drawing Figures

HOSIERY TOE CLOSERS

The present invention relates to garment manufacture.

More particularly the present invention relates to precision positioning of garments in garment processing machines such as toe closers for making toe-closing seams in tubular hosiery blanks.

It has become customary in the hosiery manufacturing field to knit elongated hose blanks in open-ended tubular form, and thereafter to perform a seaming operation to provide the blanks with closed toe ends. Specialised equipment has been developed over the last decade or so to carry out the toe closing operation.

The Detexomat (R.T.M.) Speedomatic is one well known example of a semi-automatic hosiery toe closer, and is described in the specification of our U.S. Pat. No. 1,408,912. This machine has a hose carrier upon which an open-ended, hose blank is mounted inside-out by the machine operator. The hose carrier is adapted to advance the toe end portion of a hose blank carried thereby into a clamping device. The clamping device is designed to grip the toe end portion and to move it, along a path of a predetermined contour, past a seamer which is usually a sewing machine. As the toe end portion moves past the seamer, a seam whose shape corresponds to the predetermined contour is generated, and excess hose fabric is trimmed away. During the toe closing operation, a welt end of the hose is presented to a suction everter, which is brought into operation upon completion of toe closing. The everter turns the hose right side out and discharges the seamed hose by suction to a lay-out table, a collecting bin or to another work station of a hosiery manufacturing plant, for later operations such as dyeing and packing to be performed on the hose.

The carrier employed in the Speedomatic machine comprises a suction tube fitted with a pair of elongated flat fingers or blades, the blades extending lengthwise along the length of the suction tube and the blades being reciprocally movable lengthwise in unison. The blades lie in a diametral plane of the suction tube, and one is positioned to either side of the tube. In use, an operator takes a hose blank which is right-side out and presents a toe end thereof to the suction tube. Suction draws the hose toe end first into the suction tube. When almost the entire length of the blank has entered the suction tube, the operator draws the remaining, welt end of the hose back over the outside of the suction tube and over the blades. A mechanical wind-on mechanism is then brought into operation to draw the hose from inside the suction tube fully onto the outside of the suction tube, thereby turning the hose inside out. After a short delay, during which the operator manually adjusts the position of the toe end portion on the carrier, the blades are advanced towards the clamping means. As they advance, the blades carry the toe end portion forwardly into the clamping means. Once the clamping means has gripped the toe end portion, the blades retract to their original position, and the clamping means thereafter operate to move the toe end portion past the seamer.

It is important that the operator correctly adjusts the hose on the carrier before the blades advance, otherwise the seam to be generated will be formed in an incorrect location with respect to the toe end of the blank. If the toe end portion were too far forward on the carrier, an excessive amount of waste will have to be trimmed off after seaming is completed. On the other hand, should the toe end be too far back on the carrier, it may be impossible for a proper toe closing seam to be formed in the blank.

To assist the operator to adjust the hose, the carrier is usually provided with a mark against which some identifiable feature of the hose is aligned. Such a feature might be the actual toe end of the blank, or the junction between a double knit reinforced toe end portion and the remainder of the hose knit.

Quite recently, toe closers capable of an output of over 400 pairs of hose per 8 hour shift have become available. Such machines place a substantial burden on their operators, who are allowed very little time both to load hose blanks onto the hose carriers and consistently to adjust the hose blanks properly thereon.

In the course of their manufacture, generally tubular garments other than hosiery blanks may need careful positioning on carriers. For instance, it may be convenient to place partly-finished sleeves on carriers and to machine cuffs thereto using automatic machinery. Similarly, hems or collars may be formed or affixed to sweaters by automatic machinery and likewise to finish the bottom ends of trouser legs all using machinery in which the garment item is mounted on a form or carrier. In each instance, a preliminary to the machining operation will involve careful positioning of the garment item on a form or carrier.

Accordingly, an object of this invention is to provide a method and mechanism e.g. for toe closing hosiery which will relieve the operator for manually adjusting the garment, and which will position it automatically, consistently with precision, so as to aid in saving costs in terms of manufacturing time and in unnecessary wastage of spoiled garments.

The invention accordingly provides an automatic method of setting a generally tubular garment to a predetermined position on a garment carrier, comprising drawing the garment onto the carrier to be supported internally thereby, then exerting a frictional grip on the garment and shifting the garment, while so gripped, towards the predetermined position, detecting the arrival of an identifiable feature of the garment at the predetermined position by means of a sensor thereat which, in response to detecting the said arrival, produces a control signal to cause release of the frictional grip and cessation of shifting of the garment.

The invention also provides apparatus for locating a generally tubular garment in a predetermined position in a machine for performing a processing operation on the garment, the apparatus including a garment carrier for supporting the garment internally, means actuatable to releasably exert a frictional grip on a garment supported on the carrier and to shift the garment while it is gripped thereby along the carrier toward the predetermined position, and a sensor at the said position operative, when an identifiable feature of the garment arrives at the said position, to generate a control signal to cause the garment to halt with identifiable feature coincident with the predetermined position.

The identifiable feature could be the extreme end of a garment e.g. a hose blank from which a nude-toe hose is to be made. Any other identifiable or detectable feature could be employed, however, such as some discernible change in the garment fabric. Thus, in hosiery, the feature could be the junction between a reinforced toe portion and the remainder of the hose blank.

Desirably, in apparatus embodying the invention, means are provided enabling the detector to be mounted in any one of several different predetermined positions relative to the carrer.

Advantageously, the garment gripping and shifting means is movable to and fro along the carrier and is arranged first to advance the said feature past the detector and then to return the feature to the detector whereupon it is released from the hose. Preferably, the said means advances the garment towards a free end of the carrier and then retracts it away from the free end towards the detector.

The detector can comprise a photoelectric cell coupled to a control unit which operates an electromagnetic actuator to release the said means from the garment. The actuator can be a solenoid which is energised to hold the said means in engagement with the garment. De-energising the solenoid releases the said means which can be restored rapidly to an inactive position free from the hose blank by spring means.

The garment gripping and shifting means can either grip the garment from the exterior thereof, or can exert a grip internally thereon. In the latter case, the said means is expandable to a garment-gripping state.

Conveniently, cyclically operable camming or eccentric means is linked to the said means to drive the latter and the garment along the carrier.

The preferred carrier of a hosiery toe closer embodying the invention comprises a suction tube and a pair of elongated, movable blades mounted thereon, the said blades being responsible, in use, for advancing the hose blank towards the toe-seaming means. With such a carrier, the hose-engaging means can comprise a pair of fingers movable by the actuator from inactive positions to active, hose-engaging positions in which the fingers press the hose against the blades. The fingers can be mounted on an end of a rocker arm which is rockable to and fro to move the fingers relative to the carrier to shift the hose blank therealong.

Any convenient means can be provided on the hose-engaging means to enable it to take a firm hold on the hose blank. Preferably, the hose-engaging means includes a resilient pad frictionally engageable with the hose blank.

The toe closer preferably is of the type including a plurality of hose carriers mounted on a turret so as to be indexed thereby and moved in sequence to a plurality of work stations for operations such as loading, positioning, toe seaming and unloading to be performed on hose blanks to be toe seamed.

An embodiment of the present invention will now be described by way of example with reference to the accompanying drawings, in which.

Figure 1:
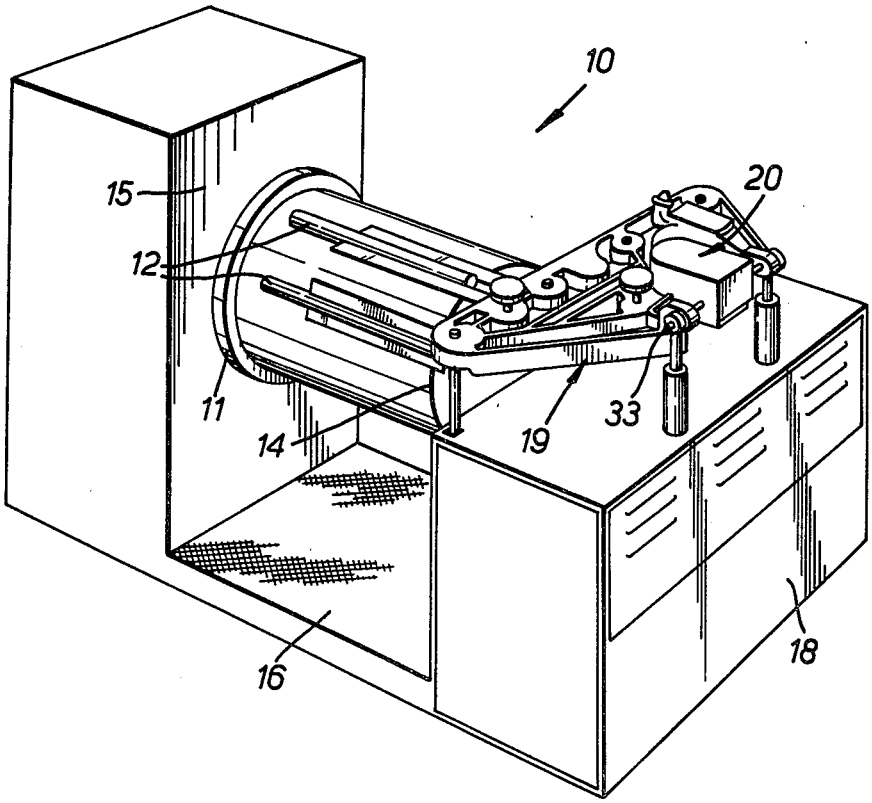
FIG. 1 is a perspective illustration of a turret toe closer embodying the invention.
Figure 2:
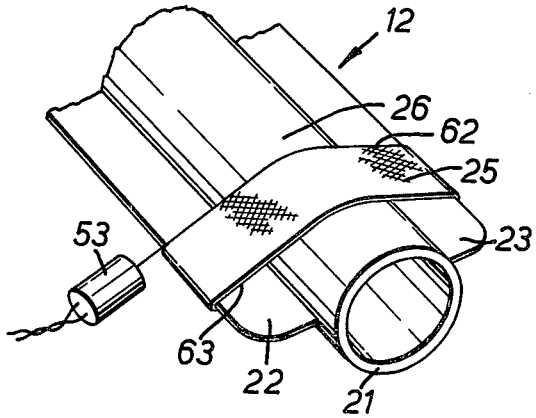
FIG. 2 is an enlarged perspective illustration of a hose carrier and hose mounted thereon.

An exemplary toe closer which may embody this invention is illustrated in FIGS. 1 to 4, and is of the vertical turret type. That is, the toe closer 10 has a vertically-disposed indexable turret 11 mounting hose carriers 12, the turret in use being rotatable stepwise about a horizontal central axis 13. The carriers 12 are elongated members which extend parallel to axis 13, and hence sweep around a cylindrical path 14 when the turret is in motion. The turret 11 is journalled for rotation in a machine housing 15 supported on a base 16. Housing 15 contains a drive motor for the turret, a mechanism such as Geneva gearing or equivalent camming or escapement means for rotatably stepping the turret, and control or timing mechanism for actuating certain items of equipment of the toe closer 10 in timed relationship with the stepping motion of the turret. The hose carriers project towards a second machine housing 18 which supports a hose clamping and transfer device 19 and a seamer in the form of a sewing machine 20. Housing 18 includes, inter alia a drive motor for the sewing machine 20.

Each hose carrier 12 includes a suction tube 21 and two elongated flat blades 22, 23. The blades 22, 23 extend lengthwise along the suction tube 21 and are disposed one to either side thereof, the blades lying in a common diametral plane. The blades are supported for reciprocating sliding movement lengthwise of the tube and in use are movable in unison from a retracted position shown in FIG. 2 to an advanced position shown in FIG. 4. The object of so advancing the blades 22, 23 is to move the toe end portion 25 of a hose blank 26 mounted on the hose carrier 12 into the hose clamping and transfer device 19. The general construction and operation of the hose carriers 12 can be as described in our B.P. specification No. 1,408,912. Reciprocating movement of the blades 22, 23 can be achieved through a push/pull rod by camming means within housing 15, the blade camming means being driven by the turret drive motor.

The hose clamping and transfer device 19 possesses similarities to the mechanism disclosed in our copending B.P. application No. 24574/74 Ser. No. 1,501,869 to which attention is directed for a detailed description. Thus, the device 19 includes a flexible endless belt 27 trained around a drive pulley 28, optionally around a plurality of idler pulleys, of which one 30 is shown, and around a plurality of preferably mutually adjustable form wheels 31, 32. Drive pulley 28 is intermittently rotated to move the belt along its path around the pulleys and form wheels by a motor for example contained within the housing 18. The motor may preferably be mounted directly on device 19. Except when servicing is needed, device 19 remains is a fixed position relative to housing 18. It is, however, mounted so as to be able to tilt up about pivots 33 or about pivots, not shown, located at one end, say the front end of device 19 as seen in FIG. 1 to give access to the belt e.g. for easy replacement thereof.

Figure 4:
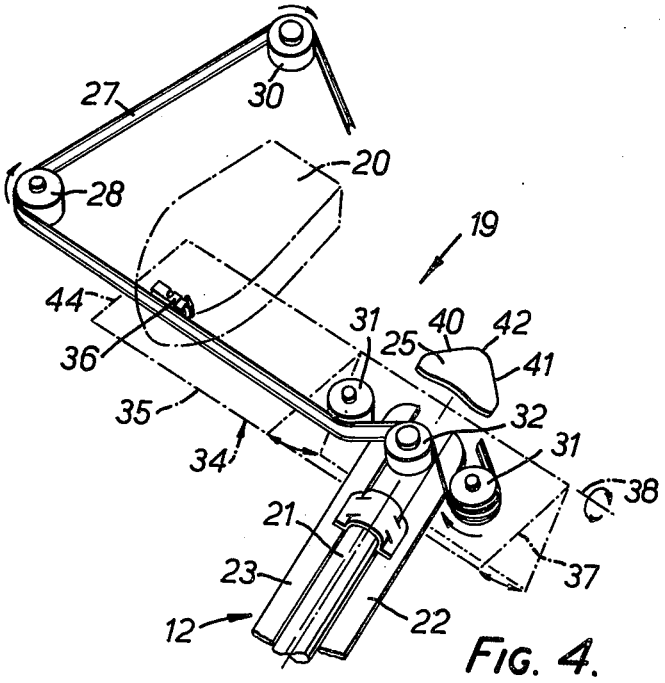
FIG. 4 is a diagrammatic illustration of hose clamping and transfer mechanism associated with a sewing machine of the toe closer.

For clamping a hose toe end portion 25, the belt 27 here cooperates with an elongated work table assembly 34 to form a nip for gripping the toe end portion 25. The assembly 34 comprises a first table section 35, which extends beneath a sewing head 36 of the sewing machine 20 and which is fixedly mounted on the housing 18, and a second table section 37 alongside the first section 35. Second section 37 is mounted so as to move between an elevated position, coplanar and co-extending with first section 35, and a lowered position. As shown in FIG. 4, the second section 37 is pivotally mounted about an axis 38 spaced from its front edge. The said axis could, however be at the junction between the sections 35,37. Section 37 is shown raised in chain dotted lines and lowered in dotted lines in FIG. 4. Mechanical means, not shown, are provided to move the second table section 37 up and down in timed relationship with indexing of the turret 11 and the movement of the blades 22, 23.

It will be noted that the second table section 37 is opposite the end of the carrier 12 and beneath the form wheels 31, 32. The means for raising and lowering the section 37 are arranged to lower the section 37 to allow the blades 22, 23 freedom to advance a toe end portion 25 into the clamping device 19. The section 37 is then raised until it is coplanar with section 35 immediately after the blades 22, 23 reach their fully advanced position shown in FIG. 4, thereby nipping the blades and the said toe end portion between itself and the belt 27. The belt 27 and work table assembly 34 hold the toe end portion securely while the blades 22, 23 are withdrawn to their original retracted positions.

The three form wheels are set up in the illustrated embodiment symmetrically with respect to the advancing blades 22, 23 in order to allow a symmetrical fish-mouth seam to be produced. A section of the belt 27 trained around the wheels 31, 32 is shaped to the contour of the required fish-mouth seam, which has two straight sections 40, 41 and an intermediate part-circular section 42. The illustrated form wheels (together with additional form wheels which may be fitted to device 19 as necessary) are adjustable relative to one another to enable seams of other shapes, e.g. Getaz, to be generated.

At the instant the hose toe end portion becomes nipped between the section of belt 27 trained around the form wheels and the raised second table section 37, it is clamped along a line of a contour corresponding to the required seam. The device 19 is so arranged that although a toe end portion may be slid along the top of the work table assembly 34, the said portion is unable to move relative to the belt when the belt is set in motion. As a result of this and the flexible, stretchable nature of the hose blank, the hose blank is stretched as the belt 27 unwinds from the form wheels 31, 32 and remains stretched as the belt 27 traverses the straight line path between one form wheel 31 and pulley 28. In the course of moving with the belt 27 along the straight path, the toe end portion is passed beneath the sewing head 36. A seam is formed in the toe end portion and excess knit is cut away therefrom as the toe end portion moves past the sewing machine 20. The toe end portion is released from the device 19 when it passes end 44 of the work table assembly. When released, the toe end portion which had been stretched as aforesaid relaxes. Upon returning to its relaxed state, the toe end portion will be formed to have a contoured seam of the required shape.

The clamping and transfer device is designed to accommodate two toe end portions. As one toe end portion is advanced past the sewing machine 20, the other is advanced from the form wheels part way along the path to the sewing machine.

Figure 3:
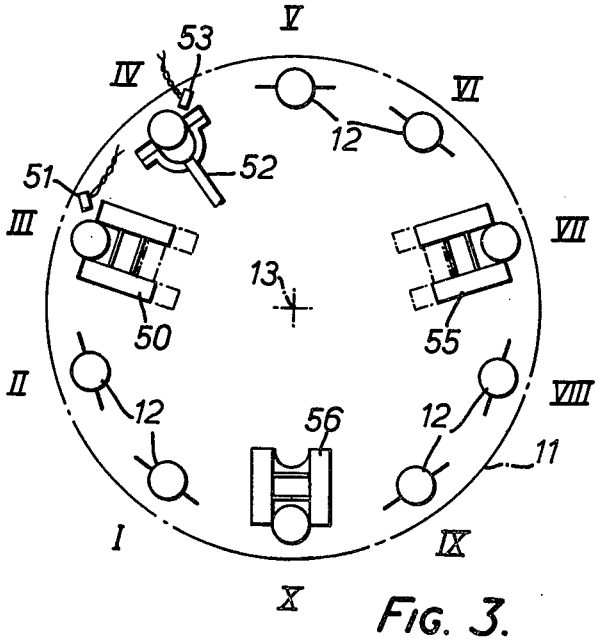
FIG. 3 is a diagrammatic end view of the turret and hose carriers of the toe closer, showing stations I to X occupied by the hose carriers when the turret is stationary.

A cycle of operations of the toe closer 10 will now be described by reference to FIG. 3. It will be appreciated that since there are a plurality of hose carriers 12 on the turret 11, a plurality of hose blanks mounted thereon are each successively subjected in turn to a sequence of operations, completion of which results in the discharge of toe-seamed hose from the machine.

The hose carrier at station I has no hose blank mounted thereon. Upon the turret indexing stepwise in a clockwise direction as viewed in FIG. 3, the said hose carrier moves to station II. At this station, the machine operator offers the toe end of an open-ended blank to the open end of suction tube 21. The opposite end of the tube 21 is temporarily connected via valving inside housing 15 to a source of suction. The hose blank is sucked toe end first into the tube 21 and twists in the fabric are removed. The operator retains hold of the welt end of the blank, and turns the welt end of the hose back over the tube 21 and over the blades 22, 23. Next the operator places the said welt end under a spring clip with which the carrier is furnished; the operator can then release the welt end, can actuate the turret drive to index the turret one step and can load the next carrier which has entered station II with another hose blank.

At station III there is a wind-on roller 50. As the indexing motion of the turret ceases, the roller 50 is advanced from an inoperative position, shown dotted, to an operative position in which it presses the said welt end against the blades 22, 23. Movement of the roller 50 between the operative and inoperative positions is under the control of camming means inside the housing 15, the said camming means being operated in response to the operation of the turret drive motor. The roller 50 is then caused to rotate, initially at high speed, to draw the hose blank onto the carrier, thereby everting the hose blank to an inside-out condition. During eversion, the toe end of the hose blank is drawn along the inside of the tube 21 towards the open end thereof. A detector, such as a photoelectric cell, not shown, is provided to sense when the moving toe end passes a given point inside the tube 21. The said point could be located adjacent the turret end of the tube. Upon sensing the said toe end, the detector emits a signal to a controller for a motor which drives the roller 50. In response to the signal, the motor is caused to rotate the roller 50 at a slower speed. During slow speed running, the roller draws the toe end out of the tube 21 and over the tube and blades 22,23. A second detector 51 similar to the first-mentioned detector senses the arrival of the toe end at a predetermined position on the carrier adjacent the end thereof. The detector 51 then emits a signal to the motor controller which accordingly stops the motor and the roller 50. Thereafter, the roller 50 is withdrawn from contact with the hose blank to its dotted inoperative position. Rather than control the operating phases of the roller drive motor by photodetecting means, simple timing means of known kinds could be employed.

For several reasons, it is not possible to position hose blank toe ends consistently and with accuracy upon the carriers by means of the wind-on roller 50. Therefore, having approximately positioned the toe end by means of the wind-on roller 50 at station III, the carrier is indexed to station IV for a positioning element 52 automatically to adjust the hose blank toe end to a prescribed correct position on the carrier 12. The construction and operation of the positioning element is described hereinafter.

In timed relation to arrival of the carrier at station V, the following actions take place. First, the second table section 37 is lowered. Then the blades 22, 23 are driven forward to place the hose blank toe end portion between the lowered section 37 and the belt 27 which is temporarily stationary. The table section 37 is next raised, nipping the toe portion between itself and the contoured section of the belt 27 trained around the form wheels 31, 32, and the blades are retracted to their original positions. The belt 27 is then driven along its endless path for a predetermined time sufficient to advance the clamped toe end portion to a ready position adjacent the sewing machine 20. Belt motion then ceases and the carrier is indexed to station VI.

Nothing happens at station VI until the belt 27 is again driven to advance to the ready position the toe end portion of another hose blank on the carrier then at station V. Once the belt commences moving, however, the toe end portion of the blank supported by the carrier at station VI is moved from the ready position past the sewing machine 20. A seam is generated in the toe end portion and excess fabric is cut away at the sewing machine. By the time the belt 27 ceases moving, the now closed toe end has passed the end 44 of table assembly 34 and has therefore been released from the device 19.

When the turret next indexes stepwise, the carrier with the closed toe end of the hose blank dangling therefrom moves to station VII. At station VII a second wind-on roller 55 positioned inwardly as shown or outwardly of path 14 and generally similar to wind-on roller 50 is moved into an operative position to draw the hose back fully onto the carrier. If desired, roller 55 could be continuously rotated. In operation, the roller may cause the seamed toe end to be stretched across the end of the carrier to straighten the toe seam. The roller 55 is returned from the operative position to an inoperative position before the turret indexes once more.

During the next three indexing movements of the turret, the carrier is moved through stations VIII and IX to station X. No operations are carried out on the hose at stations VIII and IX. At station X there is a continuously-rotated wind-off roller 56 fixedly positioned either inwardly as shown or outwardly of path 14 to engage the carrier entering station X. The roller 56 rotates in such a direction as to push the hose toe end first off the carrier. Tube 21 while at station X is connected via valving inside housing 15 to a source of suction. Accordingly, the hose at station X is sucked toe end first into and through tube 21 and is then discharged by suction from the toe closer 10 to a delivery/collection system which forms no part of this invention.

Intermittently operating mechanisms of the toe closer 10 are conveniently controlled by master camming means driven by the turret drive motor. The camming means can therefore move the wind-on rollers 50, 55 between their respective operative and inoperative positions by simple and reliable mechanical linkages. Raising and lowering of table 37 can be accomplished similarly. Control of driving motors for the wind-on rollers, the belt and the sewing machine can be by way of cam-operated switches and timers controlled thereby. It is preferred to control the intermittently operable mechanism of the toe closer mechanically and by simple electric switches on the grounds of cost, reliability, and simplicity of servicing. If desired, however, pneumatic or hydraulic actuators could be substituted for mechanical linkages.

Figure 5:
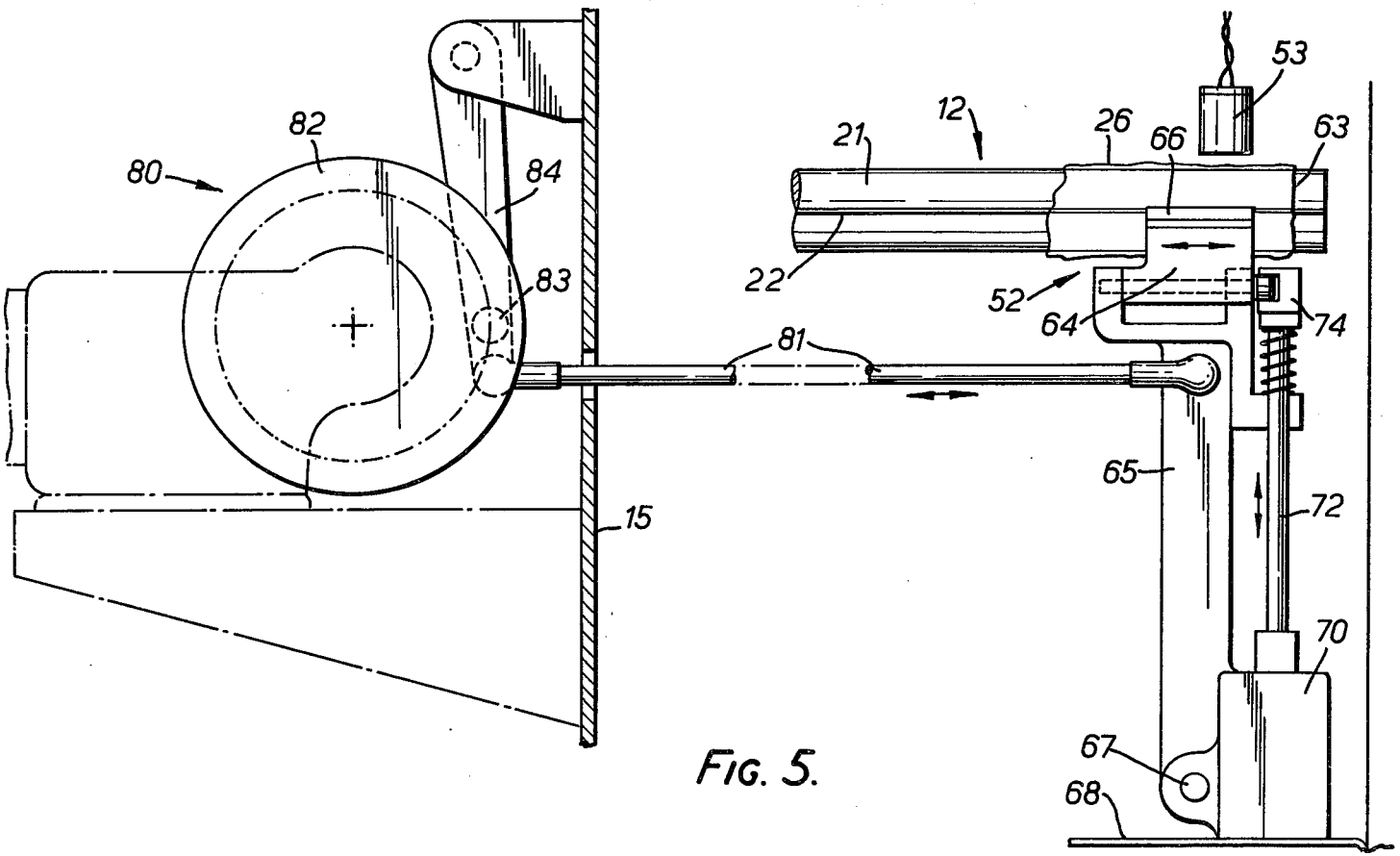
FIG. 5 is a side elevation of a hose positioner embodying features of the present invention.
Figure 6:
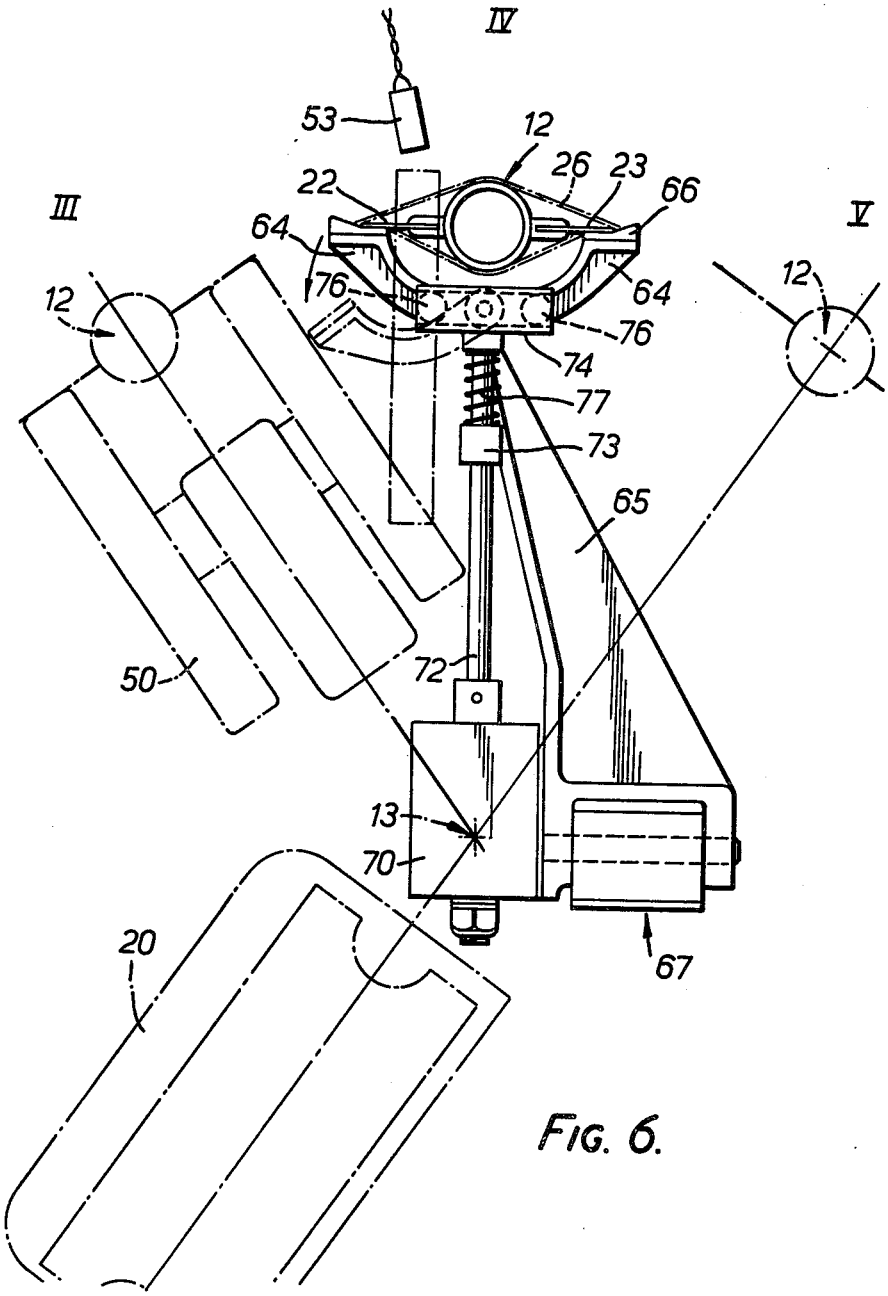
FIG. 6 is an end elevation of the hose positioner shown in FIG. 5.

The positioning element at station IV, its allied equipment and its operation will now be described with reference to FIGS. 5 and 6. The positioning element 52 is arranged to engage a hose blank 26 frictionally adjacent its toe end. The element 52 is operable to slide the toe end forward along the carrier 12 towards the free end of the latter, and then to slide it back towards the turret. A detector such as a photoelectric cell 53 is located at a prescribed position adjacent the carrier. When the detector 53 senses the arrival of some identifiable feature of the blank at a desired predetermined position on the carrier, it generates a signal that is used to release the positioning element from contact with the blank. The said feature of the hose blank can be the junction 62 between the reinforced toe portion 25 and the remainder of the blank. Alternatively, e.g. if there is no toe reinforcement, the said feature can be the extreme end 63 of the hose blank. The detector 53 is mountable in alternative positions located to suit whichever of the identifiable features is chosen.

The positioning element 52 is arranged to press the hose blank against the radially-inwardly directed faces of the blades 22, 23 in the course of adjusting the position of the toe end portion 25. Element 52 comprises a pair of fingers 64 which are pivoted together and to one end of a rocker arm 65. Outwardly-facing surfaces of the fingers 64 are covered with ½" thick foam pads 66 inter alia to avoid damaging the hose blank and to afford a good frictional grip upon the blank. The end of rocker arm 65 remote from the fingers is pivoted to a mounting 67 carried on a bracket 68 secured to any convenient location on the toe closer. Rocking movement of the arm 65 about mounting 67 causes the fingers 64 to reciprocate to and fro in the axial direction of carrier 12. In fact, the fingers will move in an arcuate path. The resilient nature of the pads 66 accommodates the slightly changing distances between the fingers and the facing surfaces of the blades 22, 23, when the fingers are in their hose-engaging positions.

The pivotal mounting of the fingers 64 to the rocker arm 65 allows the fingers to adopt active or inactive positions. Movement of the fingers is controlled by a solenoid 70 through a spring-biased push-pull rod 72. The solenoid 70 is fast with the rocker arm 65 as is a bearing 73 for the rod 72. Thus, the solenoid and rod 72 will rock with the arm 65. The end of the rod 72 remote from solenoid 70 mounts a channel-sectioned shoe 74. Two studs 76 secured to the fingers 64 extend into the channel of the shoe 74. A tension spring 77 acting between the shoe 74 and the bearing 73 serves, when the solenoid is de-energised, to hold the rod 72 and shoe 74 retracted. Instead of a tension spring, a compression spring acting between the bearing 73 and a collar fixed to the rod 72 could be used. When the shoe is retracted, the fingers 64 are held by co-operation between the studs 76 and the shoe channel in inactive positions. The inactive position is illustrated by the arm shown dotted in FIG. 6. Energising of the solenoid 70 causes the rod 72 to be pushed upwardly as seen in FIG. 6 against the bias of spring 77. Upward movement of the shoe acts through the studs 76 to raise the fingers into active, pressing engagement with the hose 25 and the inwardly-facing surfaces of blades 22, 23. Fingers 64 remain in their active positions illustrated in FIG. 6 until the solenoid 70 is deactivated.

For positioning the toe end portion of the blank, it is necessary to move the fingers 64 in the axial direction of the turret. Such movement is achieved through camming means 80 and a link rod 81. Camming means 80 comprises a rotatable cam 82 driven by a suitable motor, not shown, and a cam follower 83 mounted on a pivotally mounted lever 84. The lever 84 can be spring pressed to maintain proper engagement between the follower 83 and the track of cam 82. The link rod 81 has its ends connected via universal joints to the lever 84 and to the rocker arm 65. As indicated, the link rod 81 extends through an aperture in housing 15 which contains the camming means 80.

In operation, following an indexing movement of the turret 11 bringing a hose carrier 12 to station IV, a master camming means initiates rotation of cam 80, and the solenoid 70 is energised to move the fingers 64 to the active positions engaging the hose blank on carrier 12. Continued rotation of cam 80 causes the fingers and hose blank to be moved firstly to the right as viewed in FIG. 5, and then to the left. At an appropriate moment, e.g. during a dwell period before the fingers and hose blank begin their leftwards movement, the detector 53 is activated. Detector 53 senses arrival of the afore-mentioned identifiable feature at a desired, predetermined position, whereupon a change in the level of the output from the detector is produced. The detector output is fed to a control unit which is responsible for controlling the solenoid. The control unit deactivates the solenoid in response to the detector output change. Deactivation of the solenoid allows the spring 77 to lower rod 72 and shoe 74 so as to move the fingers 64 to their inactive positions. The hose blank is now correctly positioned ready to be advanced to the device 19.

Rotation of the camming means 80 is continued after drop-out of the solenoid to return the cam 80, follower 83, rod 81 and rocker arm to the position they originally occupied before the motor driving the cam was energised. The motor is then switched off and the positioning equipment is then ready for performing a subsequent positioning cycle.

The camming means can have the effect of producing a "throw" measured at the fingers of say 2–2½ inches.

The said control unit can follow generally conventional lines. Thus, it may amplify the detector signal and feed the amplified signal to a threshold detector. The control output of the threshold detector can then be suitably amplified as necessary and fed to a switching means either consisting of or including a relay for grounding the solenoid. Numerous suitable control circuits will occur to the designer.

The positioning equipment just described is inherently more consistent and accurate than a human can achieve. Positioning accuracy better than 1/16" is easily attainable. The equipment is particularly useful in toe closers capable of seaming upwards of 400 dozen pairs of hose per 8 hour shift, but is nevertheless useful in such machines as the Speedomatic.

In the construction so far described, each resilient pad 66 nips the hose blank between itself and the underside and outer edge of one of the blades 23. The padded fingers 64 could be arranged to nip the blank 26 between themselves and just the outer edges of the blades 23.

Instead of being rockably mounted, the positioning element 52 could be mounted on a carriage movable to and fro alongside carrier 12 on a guide rail or rails positioned beside the carrier at station IV.

The positioning element 52 engages and grips the exterior of the hose blank. It could, however, be arranged to grip the blank internally. Such an arrangement is illustrated in FIGS. 7 and 8.

Figure 7:
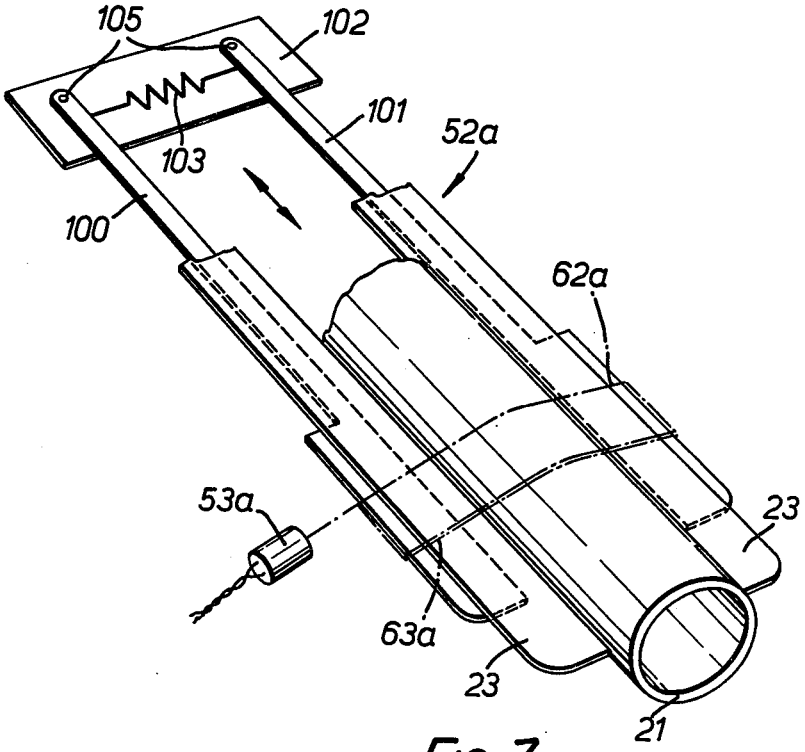
FIG. 7 is a diagrammatic illustration similar to FIG. 4 showing another hose positioner.
Figure 8:
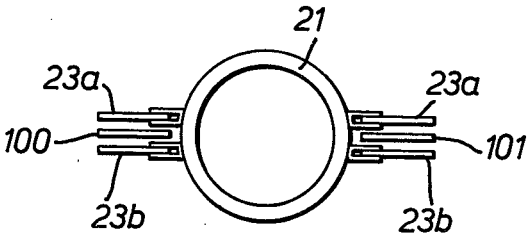
FIG. 8 is an end view of a positioner similar to that illustrated in FIG. 7.

Internally-acting positioning equipment **52*a* has a translatable and expandable mechanism comprising parts 100, 101, 102 and 103 seen in FIG. 7. Parts 100 and 101 are two fingers or blades positioned one to either side of suction tube 21 and beneath the blades 23. Part 102 is a carriage to which the fingers 100, 101 are pivoted at 105. The carriage 102 is translatable by drive means, not shown, to and fro in the direction indicated by the double-headed arrow to shift the fingers 100, 101 accordingly. 103 represents a solenoid actuator/retraction spring, the actuator being in circuit with the detector 53*a* to be operated thereby. The part 103 is shown mounted on the carriage purely for ease of illustration, and may be located elsewhere in any convenient and mechanically-advantageous position. For as long as the solenoid actuator remains energised, the forward ends 106, 107 of fingers 100, 101 are in an expanded, spread-apart condition, as shown, internally gripping the hose blank 26. In this condition, they move the identifiable feature 62*a* or 63*a* relative to the detector 53*a* as the carriage 102** is translated.

Each blade 23 of the carrier could comprise an upper and a lower blade **23*a*, 23*b* which are jointly movable when presenting the hose blank into the clamping means. With such an arrangement, the fingers 100, 101 can be sandwiched between associated pairs of blades 23*a*, 23*b* as FIG. 8** shows.

A high speed toe closer has been proposed which has a turret mounting horizontal, radially-disposed hose carriers. The carriers sweep around a circular path. Each carrier is generally similar to the carriers described hereinbefore and has fingers that move apart to hold the hose blanks in place thereon as they are presented by the carriers to a sewing machine for toe seaming. Positioning equipment as described hereinbefore could with advantage be employed in such a toe closer. Clearly, such a toe closer needs one positioner for each carrier where the positioner takes the forms shown in FIGS. 7 and 8. One positioner as shown in FIGS. 4, 5 and 6 suffices for a multi-carrier, turret type toe closer.

It will be appreciated that hose positioners as described hereinbefore can be used in single carrier toe closers. Such closers are exemplified by our Speedomatic Models H and HH.

We claim:

1. An automatic method of setting a generally tubular garment to a predetermined position on a garment carrier comprising the steps of:

(a) drawing the garment onto the carrier;

(b) moving means into frictional engagement with the garment and moving said means and at least a portion of said garment towards said predetermined position;

(c) detecting an identifiable feature of said garment at said predetermined position and generating a control signal for said means upon detection;

(d) releasing said frictional engagement means from contact with said garment upon receipt of said control signal, whereby movement of said garment ceases.

2. A method as defined in claim 1 wherein while frictionally engaged the garment is first moved toward and beyond said predetermined position and then returned toward said predetermined position, said frictional engagement means being released from said garment during return movement of said garment.

3. A method according to claim 1 wherein the garment on the carrier is frictionally engaged by moving an actuator into contact with the exterior of same and the garment is moved by moving the actuator.

4. A method according to claim 1 wherein the garment is frictionally engaged internally by an actuator that forms a part of the carrier and the garment is moved by movement of the actuator.

5. A method of closing the toe of a tubular hosiery blank comprising the steps of:

(a) setting an identifiable feature of the blank to a predetermined position on a carrier according to the method of claim 1;

(b) thereafter advancing the carrier to a toe-closing station;

(c) gripping a toe end of the blank;

(d) moving the gripped toe end past a seaming head; and (e) generating a toe seam of a given shape across the toe end of the blank.

6. A method according to claim 5 wherein said toe end is presented to the seaming head in a stretched, generally flat attitude and is maintained in said attitude while gripped and moved past the seaming head.

7. A method according to claim 5 wherein the identifiable feature on the hosiery blank is a juncture between a reinforced toe end portion of said blank and the remainder of said blank.

8. Apparatus for locating a generally tubular garment at a predetermined position in a machine for performing a processing operation on the garment comprising:

(a) a garment carrier for supporting the garment internally;

(b) means actuatable to frictionally engage a garment received on said carrier and to move said garment along said carrier while said garment is frictionally engaged; and (c) detection means located at said predetermined position, said detection means being operatively associated with said means for frictionally engaging and moving said garment to release same and stop movement of said garment upon detection of an identifiable feature on said garment.

9. Apparatus according to claim 8 wherein said carrier comprises an elongated element with moveable blade elements associated therewith and extending outwardly from opposite sides of said elongated tubular element.

10. Apparatus according to claim 8 wherein said means actuatable to frictionally engage a garment comprises frictional engagement means, means actuatable to move said frictional engagement means into contact with an exterior of said garment to grip said garment between said means and said carrier, and drive means to move said frictional engagement means generally axially with respect to said carrier.

11. Apparatus according to claim 8 wherein said frictional engagement means is received at an outer free end of a rocker arm, said rocker arm being pivotally mounted for reciprocating movement axially with respect to said carrier.

12. Apparatus according to claim 11 wherein said means for moving said frictional engagement means into contact with said garment comprises a solenoid operated push rod connected thereto, said rod being spring biased in a non-contact position.

13. Apparatus according to claim 11 wherein said drive means comprises a driven cam means operatively associated with said rocker arm.

14. Apparatus according to claim 12 wherein said rod and said rocker arm are mounted for reciprocating movement axially with respect to said carrier and said drive means comprises a driven cam means connected to said rocker arm.

15. Apparatus as defined in claim 11 wherein said frictional engagement means comprises finger elements received at an outer free end of said rocker arm.

16. Apparatus according to claim 15 wherein said finger elements have a resilient covering on the garment contact surface of same.

17. Apparatus according to claim 8 wherein said means actuatable to frictionally engage said garment comprise a pair of spaced apart pivotally mounted fingers located on said carrier, said fingers being spreadable into internal engagement with a garment on said carrier and retractable to a non-contact position, and means for spreading and retracting said fingers.

18. Apparatus according to claim 17 wherein said means for spreading and retracting said fingers comprises a solenoid.

19. A hosiery toe closer comprising:

(a) apparatus for positioning a hosiery blank on a carrier as defined in claim 8;

(b) means for moving a hosiery blank received on said carrier axially with respect to said carrier;

(c) means for generating a toe-closing seam in a toe end of said hosiery blank; and (d) means operable to receive said toe end of said blank from said blank moving means and move same past said means for generating said toe closing seam while holding said toe end portion of said blank.

20. A hosiery toe closer as defined in claim 19 wherein the carrier has moveable blade means thereto, said blade means being operable to transport said toe end portion of said hosiery blank to said toe end receiving and holding means.

21. A hosiery toe closer as defined in claim 19 wherein said carrier comprises a tubular element and a pair of moveable blades disposed along opposite sides of same, and wherein said tubular element is connectable to a source of suction whereby said hosiery blank can be everted therein.

22. A hosiery toe closer as defined in claim 19 wherein said frictional engagement means comprises means operable to move into and out of engagement with an exterior of a hosiery blank on said carrier and operable to move generally axially with respect to said carrier.

23. A hosiery toe closer as defined in claim 19 wherein said frictional engagement means comprises a pair of fingers disposed along opposite sides of said carrier and means to move said fingers into and out of engagement with an interior of a hosiery blank received on said carrier.

24. A hosiery toe closer as defined in claim 19 wherein said toe end receiving and holding means comprises a support, an endless belt mounted on said carriage and operable to receive and clamp said toe end of said blank therebetween, said belt having a path adjacent said means to generate a seam.

25. A hosiery toe closer as defined in claim 24 wherein said belt path is defined by a plurality of pulleys, said pulleys being arranged to hold said toe end in a desired position, whereby as said toe end is conveyed past said seam generating means a seam of a particular configuration is produced.

26. A hosiery toe closer as defined in claim 19 wherein a plurality of carriers are provided in turret form, said turret being indexable for sequential movement, said carriers on said turret being connectable to a source of suction at at least two locations therearound.

27. An automatic method of setting a generally tubular garment to a predetermined position on a garment carrier comprising the steps of:

(a) drawing the garment onto the carrier;

(b) moving frictional engagement means into engagement with the garment;

(c) moving said frictional engagement means and at least a portion of said garment toward and beyond said predetermined position;

(d) returning said frictional engagement means and said garment toward said predetermined position;

(e) detecting an identifiable feature of said garment at said predetermined position during said return of said garment toward said position; and (f) releasing said frictional engagement means from contact with said garment upon detection of said identifiable feature, whereby movement of said garment ceases.

28. Apparatus for locating a generally tubular garment at a predetermined position in a machine for performing a processing operation on the garment comprising:

(a) a garment carrier for supporting the garment internally;

(b) means actuatable to frictionally engage a garment received on said carrier;

(c) drive means operatively associated with said means to cyclically move said means beyond said predetermined position and to return said means toward said predetermined position;

(d) detection means located at said predetermined position and being actuated only during return movement to sense an identifiable feature of a garment to be carried therewith and automatically deactuate said means whereby frictional engagement between said means and said garment is interrupted and movement of said garment ceases at said predetermined position.

* * * * *